US009045962B2

(12) United States Patent
Christie et al.

(10) Patent No.: US 9,045,962 B2
(45) Date of Patent: Jun. 2, 2015

(54) DOWNHOLE APPARATUS HAVING A ROTATING VALVE MEMBER

(71) Applicant: Halliburton Manufacturing & Services Limited, Leatherwood (GB)

(72) Inventors: Michael John Christie, Aberdeen (GB); Stuart Gordon, Aberdeen (GB); Irvine Cardno Brown, Aberdeen (GB); Michael Adam Reid, Aberdeen (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 92 days.

(21) Appl. No.: 13/958,878

(22) Filed: Aug. 5, 2013

(65) Prior Publication Data

US 2014/0034299 A1 Feb. 6, 2014

Related U.S. Application Data

(63) Continuation of application No. 12/312,047, filed on Dec. 3, 2009, now Pat. No. 8,522,886.

(30) Foreign Application Priority Data

Oct. 24, 2006 (GB) ..... 0621031.4
Oct. 23, 2007 (GB) ..... PCT/GB2007/004054

(51) Int. Cl.
*E21B 34/06* (2006.01)
*E21B 34/08* (2006.01)

(52) U.S. Cl.
CPC ..... *E21B 34/08* (2013.01); *E21B 34/066* (2013.01)

(58) Field of Classification Search
CPC ..... E21B 34/06; E21B 34/066
See application file for complete search history.

(56) References Cited

U.S. PATENT DOCUMENTS

| | | | |
|---|---|---|---|
| 2,710,655 | A | 6/1955 | Collett |
| 3,543,849 | A | 12/1970 | Kilgore |
| 3,577,782 | A | 5/1971 | Aitken |
| 3,665,955 | A | 5/1972 | Conner, Sr. |
| 3,800,277 | A | 3/1974 | Patton et al. |

(Continued)

FOREIGN PATENT DOCUMENTS

| | | |
|---|---|---|
| EP | 0237662 | 9/1987 |
| EP | 0566382 | 10/1993 |
| GB | 1547816 | 6/1976 |
| GB | 2314863 | 1/1998 |
| GB | 2339226 | 1/2000 |

(Continued)

OTHER PUBLICATIONS

International Search Report for PCT/GB2007/004054, mailed Feb. 13, 2008.

(Continued)

*Primary Examiner* — David Andrews
(74) *Attorney, Agent, or Firm* — Alan Bryson; Fish & Richardson P.C.

(57) ABSTRACT

A downhole apparatus (10) adapted to be run on a workstring in a well bore. The apparatus has a body (12) including ports (42) and a valve (26) which is rotatable to open and close the ports to selectively allow fluid flow through the body between regions of a well bore above and below the apparatus. The valve is rotated via a gearbox (28) and motor (30) in the apparatus. A sealing arrangement between the valve and body is also described. A method of running the apparatus in a well bore and monitoring pressure above the apparatus in order to control opening and closing of the valve under predetermined conditions is presented.

20 Claims, 3 Drawing Sheets

(56) References Cited

U.S. PATENT DOCUMENTS

| | | | | |
|---|---|---|---|---|
| 4,406,335 | A | 9/1983 | Koot | |
| 4,709,762 | A | 12/1987 | Pringle | |
| 4,924,701 | A | 5/1990 | Delatorre | |
| 5,355,960 | A | 10/1994 | Schultz et al. | |
| 5,794,699 | A | 8/1998 | Hammett et al. | |
| 6,021,095 | A | 2/2000 | Tubel et al. | |
| 6,041,857 | A | 3/2000 | Carmody et al. | |
| 6,125,930 | A | 10/2000 | Moyes | |
| 6,776,240 | B2 | 8/2004 | Kenison et al. | |
| 6,782,952 | B2 | 8/2004 | Garay et al. | |
| 6,957,699 | B2 | 10/2005 | Feluch et al. | |
| 8,522,886 | B2 * | 9/2013 | Christie et al. | 166/386 |
| 2003/0047702 | A1 | 3/2003 | Gunnarsson et al. | |
| 2003/0196493 | A1 | 10/2003 | Mallison et al. | |
| 2004/0035578 | A1 | 2/2004 | Ross et al. | |
| 2004/0112608 | A1 | 6/2004 | Jackson | |

FOREIGN PATENT DOCUMENTS

| | | |
|---|---|---|
| GB | 2411677 | 9/2005 |
| GB | 2431943 | 5/2007 |
| GB | 2433083 | 6/2007 |
| WO | WO 9011429 | 10/1990 |
| WO | WO 9013731 | 11/1990 |
| WO | WO 0118357 | 3/2001 |
| WO | WO 02/46576 | 6/2002 |
| WO | WO 2005/052302 | 6/2005 |
| WO | WO 2007/049046 | 5/2007 |

OTHER PUBLICATIONS

International Preliminary Report on Patentability with the Written Opinion of the International Searching Authority (ISA) for PCT/GB2007/004054 dated Apr. 28, 2009 (6 pages).

* cited by examiner

DOWNHOLE APPARATUS HAVING A ROTATING VALVE MEMBER

This application is a continuation of, and claims the benefit of priority under 35 U.S.C. §120 to, U.S. patent application Ser. No. 12/312,047, filed Dec. 3, 2009, which claims priority to UK patent application serial no. 0621031.4, filed Oct. 24, 2006, and PCT/GB2007/004054, filed Oct. 23, 2007. The disclosure of the prior applications are considered part of, and are incorporated by reference in, the disclosure of this application.

The present invention relates to downhole technology for the oil and gas industry, and in particular to an improved apparatus for running on a workstring and method of actuation. In various aspects, the apparatus relates to a wellbore plug, an auto-fill device, and a method of running a tubing string.

During the lifetime of an oil/gas production well, various servicing operations will be carried out to the well to ensure that the efficiency and integrity of the well is maximised. These include a full work over, surface well-head tree change, side tracking or close proximity drilling operations. To allow these operations to be done safely and to accommodate verification pressure tests from surface, it is necessary to install a plug (or plugs) into the production tubing to create a barrier to both test against and provide isolation from the production zones.

These plugs are typically run into or retrieved from the wellbore on wireline or tubing strings. When running the plug in the wellbore, it may be difficult to locate the plug and/or its associated packer effectively in the correct location where there is fluid pressure beneath the plug.

Similar difficulties may arise when tubing strings, such as completion strings, are run against fluid pressure in the well. Open-ended strings will simply fill with wellbore fluid as they are run, but in many applications the tubing string will not be open, and will be positively buoyant. Auto-fill devices, which may take the form of plugs, are used to allow controlled fluid flow into a tubing string during run in.

When retrieving plugs it is necessary to equalize pressure above and below prior to unlocking and removal. Various types of pressure equalising devices have been developed, including those known as "pump open plugs" and "pressure cycle plugs". These plugs are run in with sealed ports in a closed position, and after they have served their purpose in the intervention, are opened to allow fluid flow and pressure equalisation between regions above and below the plug.

The sealed ports must resist large pressure gradients, and therefore must have high integrity. Exposure of conventional seals to wellbore fluids risks compromise to their integrity, and will not generally be acceptable. This precludes running of conventional plugs in an open configuration in which the seals would be exposed.

It is one object of the invention to provide improved downhole apparatus adapted to be run on a workstring. It is a further object of the invention to provide an improved auto-fill device or wellbore plug and method of use. It is a further object of the invention to provide an improved actuating mechanism for a downhole apparatus, an auto-fill device or a wellbore plug.

Further aims and objects of the invention will become apparent from reading of the following description.

According to a first aspect of the invention there is provided downhole apparatus adapted to be run on a workstring, the apparatus comprising a body for connecting with a workstring; one or more ports provided in the body for passage of fluid between regions of the wellbore above and below the apparatus; a valve member movable relative to the body between a first position in which the ports are open to allow fluid flow therethrough, and a second position in which the ports are closed to prevent fluid flow therethrough; wherein the valve member is connected to a drive shaft of a gearbox and motor assembly to thereby be rotated with respect to the body between the first and second positions.

Preferably, the body and the valve member are arranged longitudinally in the wellbore, and the valve member is operable to rotate about its longitudinal axis.

Preferably, the body comprises at least one opening, the valve member includes at least one aperture, and the valve member is operable to be rotated relative to the body to align and misalign said aperture with said opening in the body. More preferably, the apertures are radially oriented in the valve member.

Preferably, the body includes a pair of openings. The openings may be radially oriented and diametrically opposed on the body.

Preferably, the apparatus includes a seal arrangement for sealing the port when in its second position. Preferably, the seal arrangement includes a sealing element, which may be metal. More preferably, the seal ring provides a metal-to-metal seal around the port.

Advantageously, the seal arrangement is such that no elastically deformable seal element, for example elastomeric or rubber seals, necessary for providing the seal are exposed to wellbore fluid when the apparatus is in its first position.

Advantageously the valve member includes a part spherical surface. This surface may locate on a complementary surface of the seal arrangement.

This may be considered as a ball valve or ball choke. Advantageously, the part spherical surface locates against the sealing element, which may be held against the valve member. The metal seal ring may be radially movable with respect to the valve member. This sealing arrangement, having a part-spherical surface on a valve member that rotates with respect to the body, is well disposed to the provision of a seal that has high integrity, even after exposure to wellbore fluid.

The seal arrangement may include a retainer ring for retaining the metal sealing element. An annular space may be defined between the retainer ring and the sealing element. The seal arrangement may include an elastically deformable member and at least one back up ring, selected to maintain the seal ring in contact with the valve member and take up manufacturing tolerances. Preferably, the seal arrangement allows a metal to metal seal to be formed with constant axial loading in use.

Preferably, the seal arrangement includes a floating piston to effect a hydraulic seal. More preferably, the piston is double-acting to effect a hydraulic seal regardless of direction of pressure differential.

Preferably, the apparatus also includes an actuation subsystem. Preferably, the actuation subsystem is electronic. More preferably, the actuation subsystem comprises a motion sensor. Alternatively, or in addition, the actuation subsystem comprises at least one pressure sensor.

Preferably, the actuation subsystem comprises an inertia sensor, a processing module and means for providing an initiation signal from the processing module to initiate rotation of the valve member in response to a change in signal from the inertia sensor.

Optionally, the apparatus comprises a pressure sensor adapted to provide a signal to the processing module.

The downhole apparatus may be a dedicated valve. Alternatively, the apparatus is a plug. In this way, the apparatus includes an anchor to seal between the apparatus and the well bore above the ports. Alternatively, the downhole apparatus is an auto-fill device. The apparatus may be a sampler or a bailer.

It will be apparent that all the features described above are applicable to a valve, a plug, an auto-fill device, a sampler or a bailer.

The apparatus may be adapted to be connected to a wireline. Alternatively, the apparatus may be connected with a tubing string.

According to a second aspect of the invention, there is provided a method of running a downhole apparatus according to the first aspect on a workstring, the method comprising the steps of:

(i) Running the apparatus in the wellbore in a first position in which the ports are open to allow fluid flow therethrough;
(ii) Setting the apparatus in a location downhole;
(iii) Rotating a valve member relative to the body to a second position in which the ports are closed to prevent fluid flow therethrough.

The method may include the additional step of pressure testing against the apparatus while in its second position.

The method may include the additional step of equalizing pressure across the apparatus by rotating the valve member to its first position.

Preferably, step iii) is carried out in response to an initiation signal. The initiation signal may be produced in response to a signal received from the inertia sensor.

The method may include the step of detecting a change in the output from the inertia sensor and generating the initiation signal after a predetermined time delay.

Preferably, the method includes the step of detecting a stationary condition of the apparatus.

The method may include the additional step of overriding generation of the initiation signal if movement of the stationary condition is detected. Preferably, the time delay is reset when the apparatus detects a stationary condition of the apparatus.

The method may include the additional step of monitoring hydrostatic pressure in the wellbore via a pressure transducer provided in the apparatus. Preferably, the initiation signal is generated only if the hydrostatic pressure exceeds a predetermined threshold.

Preferably, the step of equalising pressure includes the sub-steps of:

Using a measurement from a pressure sensor provided in the downhole tool to set a reference pressure value;

Determining an applied pressure value using a measurement from the pressure sensor and the reference pressure value;

Actuating the device when the applied pressure meets a pre-determined condition.

Preferably, the method includes the steps of measuring pressure values at a plurality of sampling intervals and recording the pressure values.

Preferably, the method includes the additional step of detecting a pressure change event in the wellbore using the pressure sensor. More preferably, the method includes the step of calculating a rate of pressure change and comparing the rate of pressure change with a pre-determined threshold.

It will be appreciated that where the terms 'up' and 'down' are used in this specification, they are used in a relative sense and the invention could equally apply to deviated or horizontal wellbores, in which case the references would convert accordingly.

There will now be described, by way of example only, various embodiments of the invention with reference to the following drawings, of which:

Figure 1A:
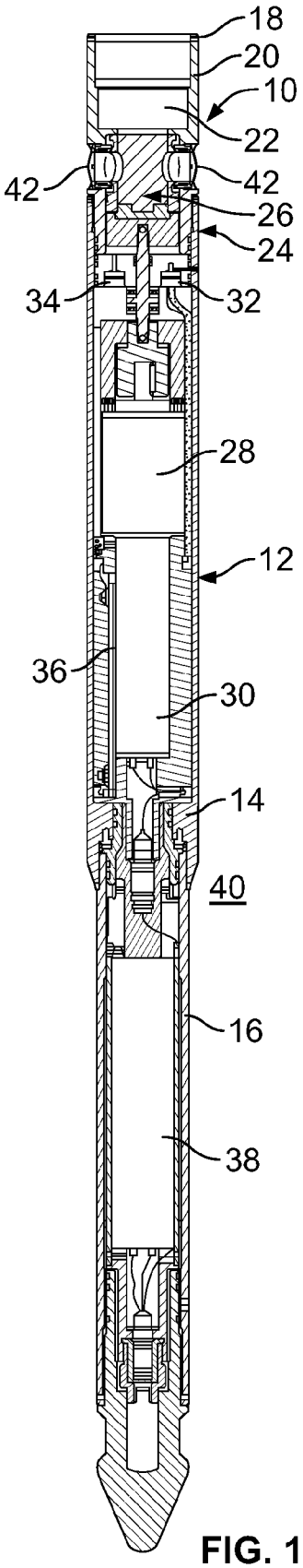
FIG. 1A is a sectional view of a wellbore plug in accordance with an embodiment of the invention in an open configuration.
Figure 1B:
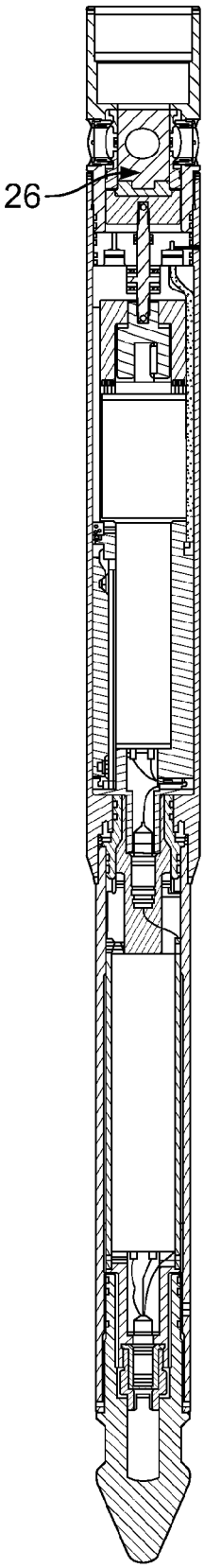
FIG. 1B is a sectional view of the wellbore plug of FIG. 1A in a closed configuration.
Figure 2:
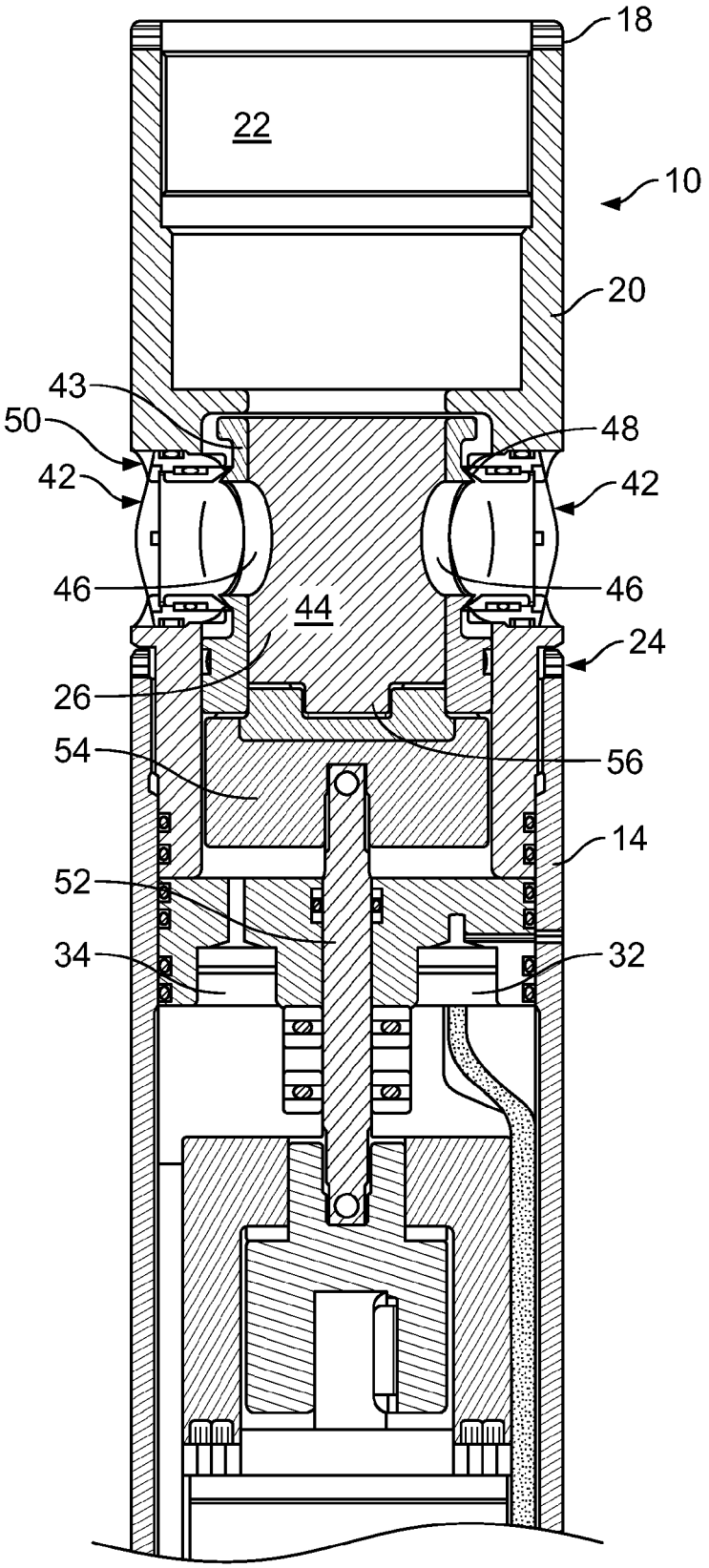
FIG. 2 is a sectional view of an actuating mechanism of the embodiment of FIGS. 1A and 1B.

Referring firstly to FIGS. 1A, 1B, and 2 there is shown a downhole apparatus in the form of a wellbore plug, generally depicted at 10.

The plug 10 comprises a substantially cylindrical main body assembly 12, comprising an upper body portion 14 and a lower body portion 16. At an upper end 18 of the upper body portion 14 is located a connector 20 for coupling the plug to a corresponding connector on an anchoring device such as a packer.

Body 12 defines an upper bore portion 22 which is a continuance of the bore of the workstring. The upper body portion 14 houses an actuating mechanism, generally depicted at 24, shown in its open position in FIG. 1A, and in its closed configuration in FIG. 1B. The actuating mechanism 24 includes a valve member 26, a gearbox 28 and a motor 30, and is described in more detail below.

Also provided in upper body portion 14 is a control system, consisting of pressure transducers 32, 34, a processing module in the form of printed circuit board (PCB) 36 and an inertia sensor, which is preferably part of the PCB. The inertia sensor could be any suitable inertia sensor, for example those known in the fields of automotive, aeronautical or medical engineering. A battery 38 in the lower body portion 16 provides power to the active components of the control system and the actuating mechanism 24. The apparatus also comprises an optional additional sub-system, which will preferably be a part of the PCB, providing for measurement of additional parameters, such as wellbore temperature.

The function of the plug 10 is to isolate a region of the wellbore above the anchor, in fluid communication with the bore 22, from a region of the wellbore below the anchor, in fluid communication with a region 40 outside of the body 12. The body 12 is provided with two radial flow ports 42, through which fluid can flow when the plug is in its open configuration, as shown in FIG. 1A.

As most clearly shown in FIG. 2, the valve member 26 has a generally cylindrical body 43, and is provided with a throughbore 44 which is a continuation of bore 22. Two diametrically opposed apertures 46 are provided in the valve member 26. The valve member 26 has a part-spherical formation 48 upstanding from the body 43, and through which the apertures 46 extend. The apertures 46 are aligned or misaligned with the ports on 42 on the body 14, to allow or cut off fluid flow between the region 40 and the bore 22, depending on the position of the valve member 26. The part-spherical formation 48 provides a spherical surface on which the seal arrangement, generally shown at 50, seals around the apertures 46. The seal arrangement 50 is described in more detail below.

The valve member 26 is rotatable with respect to the body 14, and is coupled to the gearbox 28 via a drive shaft and drive member. Castellations on the valve member 26 key with complementary castellations on the drive member 54, which transfers torque from the drive shaft 52. The opening and closing of the fluid path is dependent on an actuation signal being provided to the motor 30. When the motor is actuated, it rotates the drive shaft 52 via the gearbox 28. Reverse rotation of the drive shaft 52 can be effected by reverse rotation of the motor or selection of a reverse gear.

Figure 3:
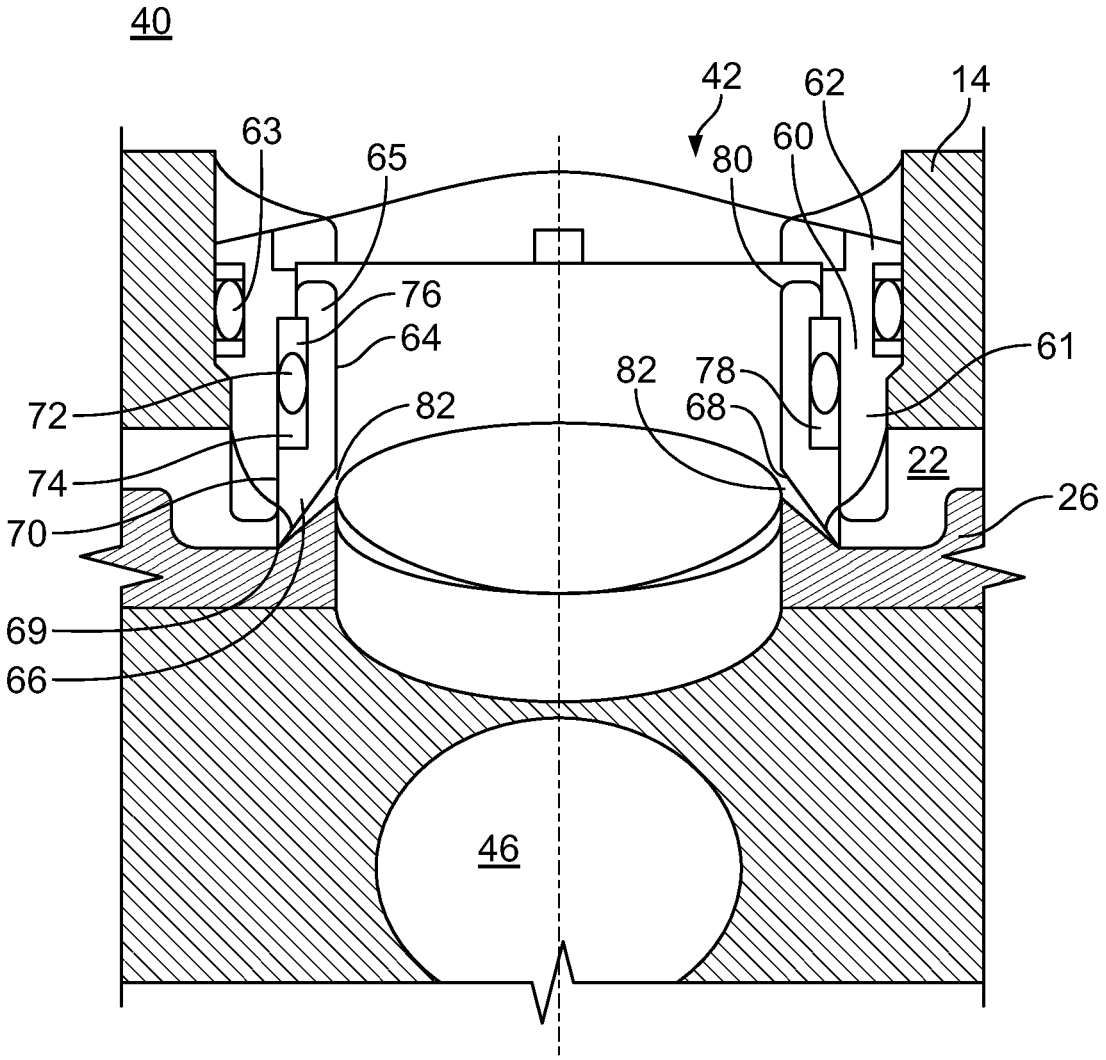
FIG. 3 is a sectional view of the seal arrangement of the embodiment of FIGS. 1 and 2 in the closed position of the plug.

Referring now to FIG. 3, the sealing arrangement 50 is shown in more detail in the closed configuration of the plug 10. The sealing arrangement 50 includes an annular retaining ring 60, located in the port 42 of the body 14. The annular retainer ring 60 is fixed to the body 14 and surrounds the port 42. The ring 60 includes an inner cylindrical portion 61 and an outer collar portion 62. A seal 63 is provided between the ring 60 and the body 14 to prevent fluid flow therethrough.

The function of the ring 60 is to retain the seal element, which is in the form of radially movable valve seat 64. The seat 64 is substantially annular in shape, and is disposed in the port 42. The seat 64 is metal, and defines a lower surface 68 complementary to the surface of the metal valve member 26. In this example, the lower surface includes a circular seal ring 69. The seat 64 has an outer cylindrical portion 65 and an inner collar portion 66.

The retainer ring 60 and the seat 64 define an annular space 70 between the respective faces of the collar portions 62, 66 and the sidewalls. Disposed within the annular space 70 are an elastically deformable seal 72 and inner and outer back up rings 74, 76. The seal 72 and the back up rings 74, 76 together substantially fill the annular space 70. The seal 72 is made from an elastomeric material, and the back up rings are in this embodiment made from a relatively hard plastic material such as Teflon®.

The sealing arrangement provides a double piston effect metal-to-metal seal. In other words, the seal functions regardless of direction of the pressure differential across the seal. The seal arrangement functions as follows.

The valve member 26, as shown in FIGS. 1B and 3, is in its closed position to prevent fluid flow between a region 40 beneath the plug and the bore 22. The dimensions of the seal 72 and back up rings 74, 76 are selected to take up any manufacturing intolerances and ensure contact of the seat 64 with the valve member 26 via the seal ring 69. When the pressure in the bore 22 is greater than that in the region 40, wellbore fluid enters the annular space 70 beneath the seal 72 through the gap between the ring 60 and the seat 64. The high pressure forces the seal 72 and inner back up ring 76 upwards, and also acts on the inner bearing surface 78 defined by the inner collar portion 66 of the seat. This forces the seat 64 into sealing contact with the valve member.

When the pressure in the region 40 is greater than that in the bore 22, wellbore fluid will act on the outer surface 80 of the cylindrical portion of the seat 64. Wellbore fluid also enters the annular space 70 above the seal 72 through the upper gap between the ring 60 and the seat 64. The high pressure forces the seal 72 downwards, into contact with the inner backup ring 74, which in turn acts on the inner bearing surface 78 defined by the inner collar portion 66 of the seat. The resultant downward force on the outer surface 80 and the bearing surface 78 is greater than the upward force on the smaller area 82 of the lower surface 68. The net force is therefore downward, forcing the seat 64 into sealing contact with the valve member 26.

In use, the plug may run-in in the open configuration, with the apertures 46 aligned with the ports 42 in the body 14. This provides a radial path for the flow of fluid from the region 40 below the plug to the bore 22 and the region above the plug. While the tool is being run, the ports are open allowing fluid to flow from the wellbore into the upper bore portion 22 and into the internal bore of the main work string above the plug or vice versa.

The plug remains open until an actuation signal is provided to the motor which causes the valve member 26 to be rotated from the position shown in Figure IA to the position shown in FIG. 1B. That is, the ports defining a fluid path from the region 40 and the bore portion 22 are moved from an open to a closed position. The metal-to-metal seal between the seat 64 and the valve member 26 seals the internal bore against well bore pressure and allows the plug to be set in the wellbore. Subsequently, the intervention or pressure tests can be carried out against the sealed plug. When the intervention operation is complete, and the plug is required to be retrieved, the plug can be opened by rotation of the valve member 26 to uncover the ports 42 and equalise the pressure across the device.

A variety of techniques could be used to initiate opening or closing of the plug. In a preferred embodiment, the initial setting of the plug to its closed configuration is by the method described in the Applicant's co-pending UK Patent Application GB 2,433,083, the contents of which are incorporated herein by reference.

In that technique, the plug 10 is run in hole, and the system monitors the hydrostatic pressure measured by one or both of the transducers 32, 34 and movement of the apparatus via inertia sensor. Optionally, other parameters, such as wellbore temperature, may be monitored by a sub-system. When the inertia sensor detects that movement of the apparatus has stopped, a signal is provided to the processing module. A clock measures the time at which the apparatus is held steady in the well, and the system determines when the apparatus has remained stationary for a time exceeding a predetermined period. However, in this embodiment, the processing module will only generate an output actuating signal if the hydrostatic pressure measured by the transducer exceeds a predetermined value. If the pressure condition and movement conditions are both satisfied, the actuation signal will be generated.

If the tool is moved before the actuation signal is generated, this is detected by the inertia sensor and the timer is re-set. When the apparatus returns to a stationary condition, the timer begins again. The hydrostatic pressure measurement via pressure sensor allows the apparatus to be left in a stationary condition downhole without initiation, by pulling the apparatus above a depth corresponding to the threshold hydrostatic pressure. The actuation signal will not be generated because the hydrostatic pressure threshold is not exceeded.

This actuation method does not rely on a means of communication from the surface such as a conductor to provide an initiation signal. The invention does not require the provision of lengthy time delays used in the prior art to allow for running and retrieval of tools. The inertia sensor, which would override and prevent actuation if the tool was being retrieved, allows embodiments of the invention to have significantly shorter, or in some cases zero, time delay. The optional inclusion of a hydrostatic pressure measurement provides additional flexibility to the system, as it allows the apparatus to be kept stationary downhole for a period of time exceeding the inbuilt time delay, providing that the apparatus is at a depth above the hydrostatic pressure threshold.

In an alternative embodiment, the initiation signal is based purely on a timer signal or a hydrostatic pressure value.

In the preferred embodiment, the signal to actuate the opening of the wellbore plug to equalise pressure is generated using the pressure actuated technique described in the Applicant's co-pending Patent Application WO2007/049046, the contents of which are incorporated herein by reference. In that technique, the pressure transducer 34 is used to set a reference pressure value by monitoring pressure characteristics in the wellbore.

The pressure above the plug is increased from the surface of a wellbore, and an applied pressure value using measurement from the pressure sensor and the reference pressure value is calculated. When this calculated applied pressure falls within the predetermined range for a specified time period, the pressure equalising signal is generated, which actuates the motor to rotate the valve member and open the valve.

In this way, the reference point is used as a reference for the conditions at which the pressure equalizing mechanism actuates. When the pressure at the surface of the wellbore is increased by a specified amount (falling within the "opening window") the calculated applied pressure will correspond to the pressure applied at surface i.e. the pressure applied at surface does not need to be adjusted to take account of variations in wellbore pressure downhole.

The embodiment of FIGS. 1 to 3 is an example of an application of the actuating mechanism of the present invention to a plug connected to a tubing string.

However, the invention in its various aspects could equally be applied to a more general auto-fill device for a tubing string.

The invention also has application to wellbore plugs run on wireline, which advantageously may also be run in an open configuration, for example to ease setting in the desired location. The actuation mechanism may also be applied to samplers and bailers.

In an alternative embodiment of the present invention the PCB is located below the motor. A first piston is then arranged around the drive shaft such that its upper surface is acted upon by pressure above the apparatus i.e. pressure in the work string, when the valve is closed and the pressure through the ports, when the valve is open. The lower side of the piston acts on a sealed oil chamber arranged around the motor and gearbox assembly. The chamber ends at an upwardly directed face including a pressure transducer. It is this pressure transducer which effectively measures the pressure above the apparatus. A second pressure transducer is located at the end of the chamber, but is directed to an outer surface of the apparatus to determine the pressure 'downhole' i.e. below the apparatus.

In use, once the tool has been set in a well, it periodically samples the pressure above it. When the system detects a slow change in pressure, it considers this a change in hydrostatic pressure and continues to self-zero. When the system detects a faster change in pressure, it uses this as an indication that pressure is being applied at the surface. In the event of this happening, the pressure history is used to determine the current hydrostatic pressure. The device then monitors the pressure that is applied at surface. If the pressure applied at surface is parked within a pre-determined window for a predetermined length of time this will be considered an opening command. The initiation signal is then sent to the motor and gearbox to rotate the valve to the open position.

Tests can be performed at pressures above and below the opening window without the valve opening. The device will only respond to the opening command on pressure up. If the pressure goes above the opening window and then goes down into the opening window, the device will not respond. The device will begin to start self-zeroing again once it has determined that a pressure test has ended i.e. when there is no longer pressure being applied at surface.

This embodiment also comprises a data download port through which historical data on pressure, temperature and other variables can be downloaded when the apparatus is brought back to the surface. This is provided as the apparatus does not require to send pressure and temperature data to the surface to operate. Indeed no surface control is required to operate the apparatus removing the requirement for connections between surface and downhole.

The present invention in its aspects provides downhole apparatus to be run in a wellbore that has a rotating valve member operated from a gearbox and motor assembly and/or a metal-to-metal seal. The structure of the valve member and associated sealing arrangement allows the apparatus to be run-in in an open configuration without compromising the seal integrity. This allows fluid to fill the tool string during running in, or allowing circulation of high density fluid in a well kill application. The present invention provides an initiation method suitable for closing the valve when pressure integrity is required. The apparatus can then be closed to provide a seal, and subsequently opened and re-closed as many times as is necessary, with reduced damage to the seal.

The apparatus advantageously has the facility to be opened by applying a certain pressure at surface for a certain length of time. In order to allow it to determine the pressure applied at surface, the apparatus also advantageously compensates for the hydrostatic pressure above it.

The use of a timer, inertia sensor or hydrostatic pressure signal to initiate closing of the valve has particular application to downhole tools and apparatus for which actuation by controlled application of pressure from the surface may not be suitable, for example wireline or slickline tools, or completion strings having other components initiated by application of pressure cycles.

Various modifications and improvements to the above described embodiments may be made within the scope of the invention herein intended.

The invention claimed is:

1. A downhole tool, comprising:

a housing that comprises one or more ports that define a fluid pathway between a bore that extends through at least a portion of the housing and an annulus of a wellbore;

a valve assembly that comprises a body and one or more apertures that define a fluid pathway between a throughbore of the body and the one or more ports, the body moveable between a first position that aligns the one or more apertures and the one or more ports to permit fluid communication between the bore and the annulus and a second position that misaligns the one or more apertures and the one or more ports to prevent fluid communication between the bore and the annulus;

a drive assembly operatively coupled to the valve assembly and configured to move the body between the first and second positions; and a seal assembly positioned adjacent the one or more ports and comprising a seal member that forms a metal-to-metal seal between the one or more ports and the body when the body is in the second position to prevent fluid communication between the bore and the annulus, the seal member radially moveable relative to the body.

2. The downhole tool of claim 1, wherein the seal member comprises a curved surface in sealing contact with a radiussed surface of the body when the body is in the second position.

3. The downhole tool of claim 1, wherein the drive assembly comprises:

a power source;

a motor coupled to the power source; and a drive shaft coupled between the motor and the body and configured to rotate the body in the valve assembly based on operation of the motor.

4. The downhole tool of claim 3, further comprising an electronic actuation subsystem.

5. The downhole tool of claim 4, wherein the actuation subsystem comprises at least one of a motion sensor, an inertia sensor, or a pressure sensor.

6. The downhole tool of claim 5, wherein the actuation subsystem is communicably coupled to the drive assembly and configured to provide an actuation signal to the drive assembly based on a measurement from at least one of the motion sensor, the inertia sensor, or the pressure sensor.

7. The downhole tool of claim 6, wherein the drive assembly is configured to adjust the valve member to move the body between the first and second position based on the actuation signal.

8. The downhole tool of claim 1, wherein the tool comprises at least one of a valve, a plug, or an auto-fill device.

9. A method, comprising:

running a downhole tool into a wellbore in a first position, the downhole tool comprising:

a housing that comprises a bore and one or more ports at an exterior surface of the housing;

a valve assembly that comprises a body and one or more apertures that define a fluid pathway between a throughbore of the body and the one or more ports of the housing, the body positioned in a first state that aligns the one or more apertures and the one or more ports in the first position of the downhole tool;

a drive assembly operatively coupled to the valve assembly; and a seal assembly positioned adjacent the one or more ports and comprising a seal member;

setting the downhole tool in the wellbore;

circulating fluid through the bore and through the one or more apertures and one or more ports to an annulus of the wellbore; and adjusting the body of the valve assembly from the first state to a second state to place the downhole tool in a second position, the body positioned in the second state that misaligns the one or more apertures and the one or more ports in the second position of the downhole tool, seal member forming a metal-to-metal seal between the one or more ports and the body when the body is in the second state to prevent fluid communication between the bore and the wellbore, the seal member radially moveable relative to the body.

10. The method of claim 9, further comprising:

circulating the fluid or another fluid to the bore of the housing when the downhole tool is in the second portion; and pressure testing the seal member of the seal assembly with the fluid or another fluid when the downhole tool is in the second position.

11. The method of claim 9, further comprising:

detecting an initiation signal based on data from at least one of an inertia sensor, a pressure sensor, or a motion sensor; and in response to the initiation signal, adjusting the body of the valve assembly between the first state and the second state.

12. The method of claim 11, further comprising:

waiting a predetermined time delay after detecting the initiation signal; and initiating adjustment of the body of the valve assembly between the first state and the second state after the predetermined time delay.

13. The method of claim 11, further comprising:

detecting motion of the downhole tool in the wellbore by the motion sensor;

overriding generation of the initiation signal based on the detected motion; and setting or resetting a time delay based on the detected motion.

14. The method of claim 11, further comprising:

measuring wellbore hydrostatic pressure with the pressure sensor;

determining that the measured wellbore hydrostatic pressure exceeds a predetermined pressure value; and based on the determination that the measured wellbore hydrostatic pressure exceeds the predetermined pressure value, generating the initiation signal.

15. A wellbore apparatus, comprising:

a housing comprising an upper end configured to couple to a downhole conveyance and a lower end configured to anchor to a wellbore, the housing further comprising one or more ports that define a fluid pathway between a bore that extends through at least a portion of the housing and an annulus of the wellbore;

a flow controller that comprises a body and one or more apertures that define a fluid pathway between a throughbore of the body and the one or more ports, the body moveable between a first position that aligns the one or more apertures and the one or more ports to permit fluid communication between the bore and the annulus and a second position that misaligns the one or more apertures and the one or more ports to prevent fluid communication between the bore and the annulus;

a drive assembly operatively coupled to the flow controller and configured to move the body between the first and second positions;

a seal assembly positioned adjacent the one or more ports and comprising a seal member that forms a metal-to-metal seal between the one or more ports and the body when the body is in the second position to prevent fluid communication between the bore and the annulus, the seal member radially moveable relative to the body; and a control system communicably coupled to the drive assembly and operable to control the drive assembly to move the body between the first and second positions.

16. The wellbore apparatus of claim 15, wherein the flow controller comprises one of a ball valve or a ball choke.

17. The wellbore apparatus of claim 15, wherein the seal member is configured to operate as a floating piston that forms the metal-to-metal seal between the one or more ports and the body when a pressure in the bore is greater than a pressure in the annulus and when the pressure in the bore is less than the pressure in the annulus.

18. The wellbore apparatus of claim 15, wherein the control system is at least partially enclosed in the housing.

19. The wellbore apparatus of claim 15, wherein the control system comprises a PCB controller communicably coupled to a motor of the drive assembly.

20. The wellbore apparatus of claim 15, wherein the downhole conveyance comprises one of a wireline or a tubing.

* * * * *

UNITED STATES PATENT AND TRADEMARK OFFICE

CERTIFICATE OF CORRECTION

PATENT NO. : 9,045,962 B2
APPLICATION NO. : 13/958878
DATED : June 2, 2015
INVENTOR(S) : Michael John Christie et al.

It is certified that error appears in the above-identified patent and that said Letters Patent is hereby corrected as shown below:

Title page Item (71) Applicant, line 2, replace "Leatherwood" with -- Leatherhead --

In the Claims,

Column 8, line 54, Claim 2, replace "radiussed" with -- radiused --

Signed and Sealed this
Eighth Day of December, 2015

Michelle K. Lee

Michelle K. Lee
*Director of the United States Patent and Trademark Office*